US009284853B2

(12) United States Patent
Nanda et al.

(10) Patent No.: US 9,284,853 B2
(45) Date of Patent: Mar. 15, 2016

(54) SYSTEM AND METHOD FOR INTEGRATING SECTIONS OF A TURBINE

(75) Inventors: Deepesh Dinesh Nanda, Bangalore (IN); Gunnar Leif Siden, Greenville, SC (US); Craig Allen Bielek, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 608 days.

(21) Appl. No.: 13/277,972

(22) Filed: Oct. 20, 2011

(65) Prior Publication Data

US 2013/0101387 A1 Apr. 25, 2013

(51) Int. Cl.
*F01D 25/30* (2006.01)

(52) U.S. Cl.
CPC ..... *F01D 25/30* (2013.01)

(58) Field of Classification Search
CPC ..... F04D 29/547; F04D 29/545; F01D 25/30
USPC ..... 415/182.1, 211.2, 220
See application file for complete search history.

(56) References Cited

U.S. PATENT DOCUMENTS 3,625,630 A * 12/1971 Soo ..... 415/207
4,550,562 A * 11/1985 Rice ..... 60/772
5,102,298 A * 4/1992 Kreitmeier ..... 415/211.2
5,301,500 A * 4/1994 Hines ..... 60/792
5,338,155 A * 8/1994 Kreitmeier ..... 415/211.2
6,488,470 B1 12/2002 Owczarek
6,779,973 B2 8/2004 Ito et al.
7,410,343 B2 8/2008 Wakazono et al.
2002/0159886 A1* 10/2002 Hiyama et al. ..... 415/207
2009/0191052 A1* 7/2009 Haller ..... 415/207
2010/0021291 A1* 1/2010 Beeck ..... 415/207
2010/0071342 A1* 3/2010 Siden et al. ..... 60/39.182
2010/0226767 A1* 9/2010 Becker et al. ..... 415/207
2012/0045324 A1* 2/2012 Siden et al. ..... 415/207
2012/0102956 A1* 5/2012 Nanda et al. ..... 60/722

OTHER PUBLICATIONS

Optimization Strategy for a Coupled Design of the Last Stage and the Successive Diffuser in a Low Pressure Steam Turbine, GT2011-46180, Mucsh et al., 9 pages, Proceedings of ASME Turbo Expo 2011, Jun. 2011, Vancouver, Bristish Columbia, Canada.*
Chinese Office Action for CN Application No.: 201210400869.6 mailed Sep. 11, 2015, 7 pages.

* cited by examiner

*Primary Examiner* — Richard Edgar
(74) *Attorney, Agent, or Firm* — Fletcher Yoder, P.C.

(57) ABSTRACT

A system and method for integrating sections of a turbine are provided. In one system, a turbine includes a last stage bucket section with a first annular outer wall that is angled with respect to a centerline of the turbine at a first angle average. The turbine also includes a diffuser section having a second annular outer wall that is angled with respect to the centerline of the turbine at a second angle average for improving radial swirl. The first angle average is greater than the second angle average.

10 Claims, 3 Drawing Sheets

SYSTEM AND METHOD FOR INTEGRATING SECTIONS OF A TURBINE

BACKGROUND OF THE INVENTION

The subject matter disclosed herein relates generally to turbines and, more specifically, to integrating sections of a turbine system.

A turbine system may include an exhaust diffuser section coupled to a turbine section downstream of the turbine section. Such a turbine system may be either a gas turbine system or a steam turbine system. Specifically, a gas turbine system combusts a mixture of fuel and air to generate hot combustion gases, which in turn drive one or more turbines. In particular, the hot combustion gases force turbine blades to rotate, thereby driving a shaft to rotate one or more loads, e.g., electrical generators, and so forth. The exhaust diffuser section receives the exhaust from the turbines, and gradually reduces the pressure and velocity of the exhaust. Certain turbine systems include a turbine section and a diffuser section that are independently designed for optimal performance. Unfortunately, when such systems are integrated, the combined turbine section and diffuser section may not function optimally.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system has a turbine that includes a last stage bucket section with a first annular outer wall that is angled with respect to a centerline of the turbine at a first angle average. The turbine also includes a diffuser section having a second annular outer wall that is angled with respect to the centerline of the turbine at a second angle average for improving radial swirl. The first angle average is greater than the second angle average.

In a second embodiment, a system has a turbine with an outer wall transition from a last stage bucket outer wall to a diffuser section outer wall. The last stage bucket outer wall is angled away from a centerline of the turbine at a first angle that is greater than a second angle at which the diffuser section outer wall is angled away from the centerline of the turbine.

In a third embodiment, a method includes providing a last stage bucket section of a turbine that is outwardly angled with respect to an axial centerline of the last stage bucket section from a first axial end of the last stage bucket section to a second axial end of the last stage bucket section at a substantially constant first angle. The method also includes providing a diffuser section of the turbine that is outwardly angled with respect to an axial centerline of the diffuser section at a first axial end of the diffuser section at a second angle. The first angle is greater than the second angle. The method includes attaching the second axial end of the last stage bucket section to the first axial end of the diffuser section.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed below, certain embodiments of a turbine system include an integrally designed last stage bucket section and diffuser section. For example, the last stage bucket section may have an outer wall that is angled with respect to a centerline of the turbine (e.g., at a first angle average). Further, the diffuser section may have an outer wall that is angled with respect to the centerline of the turbine (e.g., at a second angle average). The last stage bucket section may be integrally designed with the diffuser section so that the first angle average, at which the outer wall of the last stage bucket section is angled, is greater than the second angle average, at which the outer wall of the diffuser section is angled. For example, in certain embodiments, the first angle average at which the outer wall of the last stage bucket section is angled may be approximately 2-15 degrees greater than the second angle average at which the outer wall of the diffuser section is angled. Consequently, due at least in part to the greater angle average of the outer wall of the last stage bucket section, the integrally designed system may increase radial swirl and efficiency of the turbine system.

Figure 1:
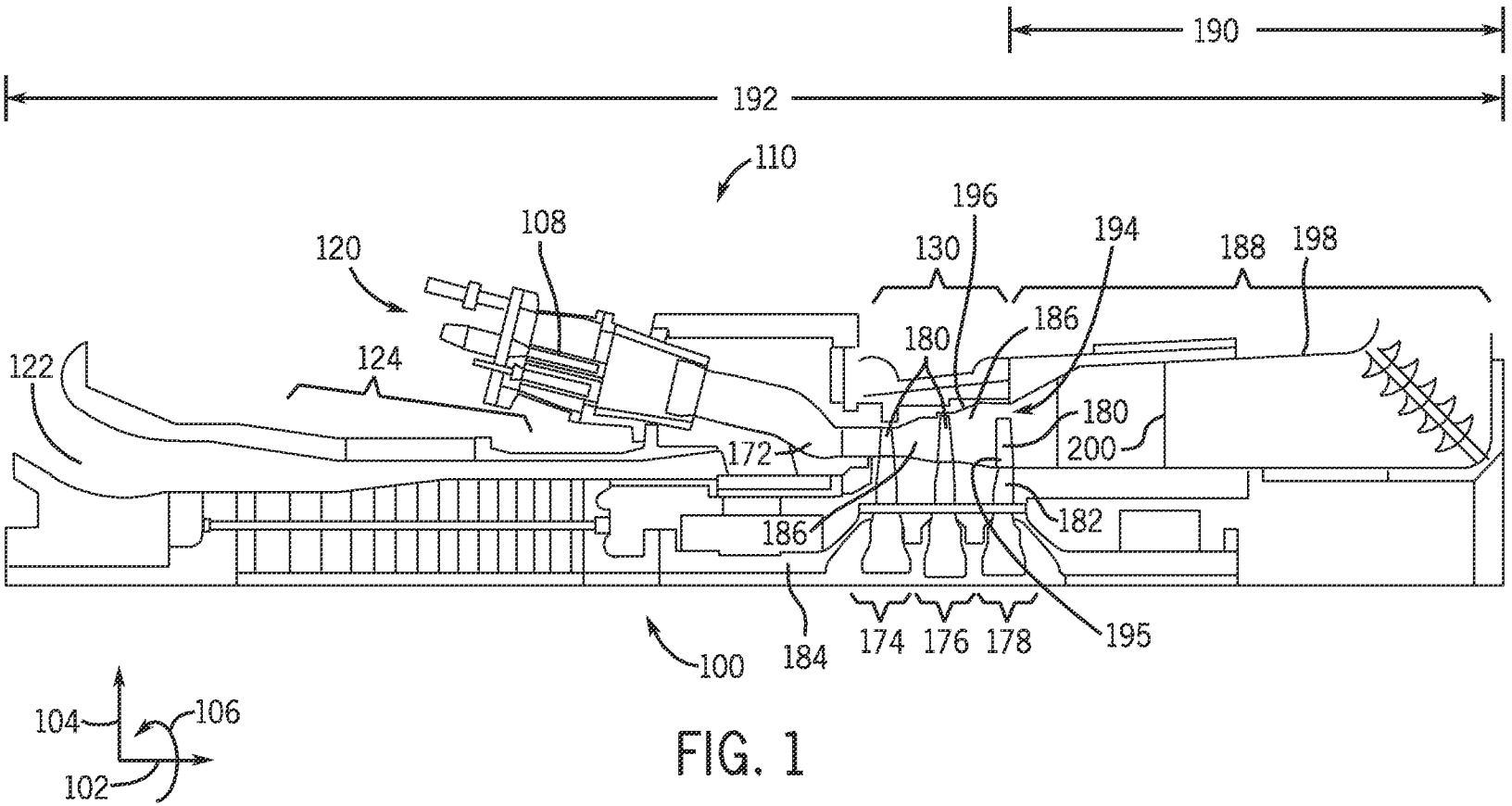
FIG. 1 illustrates a cross-sectional side view of an embodiment of a gas turbine system.

Turning now to the drawings and referring first to FIG. 1, an embodiment of a gas turbine engine 100 is illustrated. The gas turbine engine 100 extends in an axial direction 102. A radial direction 104 illustrates a direction extending outward from an axis of the gas turbine engine 100. Further, a circumferential direction 106 illustrates the rotational direction around the axis of the gas turbine engine 100. The gas turbine engine 100 includes one or more fuel nozzles 108 located inside a combustor section 110. In certain embodiments, the gas turbine engine 100 may include multiple combustors 120 disposed in an annular (e.g., circumferential 106) arrangement within the combustor section 110. Further, each combustor 120 may include multiple fuel nozzles 108 attached to or near a head end of each combustor 120 in an annular (e.g., circumferential 106) or other arrangement.

Air enters through an air intake section 122 and is compressed by a compressor 124 of the gas turbine engine 100. The compressed air from the compressor 124 is then directed into the combustor section 110 where the compressed air is mixed with fuel. The mixture of compressed air and fuel is generally burned within the combustor section 110 to generate high-temperature, high-pressure combustion gases, which are used to generate torque within a turbine section 130 of the gas turbine engine 100. As noted above, multiple combustors 120 may be annularly (e.g., circumferentially 106) disposed within the combustor section 110 of the gas turbine engine 100. Each combustor 120 includes a transition piece 172 that directs the hot combustion gases from the combustor 120 to the turbine section 130 of the gas turbine engine 100. In particular, each transition piece 172 generally defines a hot gas path from the combustor 120 to a nozzle assembly of the turbine section 130, included within a first stage 174 of the turbine section 130 of the gas turbine engine 100.

As depicted, the turbine section 130 includes three separate stages or sections 174 (i.e., first stage or section), 176 (i.e., second stage or section), and 178 (i.e., third stage or section, or last turbine bucket section). Although illustrated as including three stages 174, 176, 178, it will be understood that, in other embodiments, the turbine section 130 may include any number of stages. Each stage 174, 176, and 178 includes blades 180 coupled to a rotor wheel 182 rotatably attached to a shaft 184. As may be appreciated, each of the turbine blades 180 may be considered a turbine bucket, or a bucket. Each stage 174, 176, and 178 also includes a nozzle assembly 186 disposed directly upstream of each set of blades 180. The nozzle assemblies 186 direct the hot combustion gases toward the blades 180 where the hot combustion gases apply motive forces to the blades 180 to rotate the blades 180, thereby turning the shaft 184. As a result, the blades 180 and shaft 184 rotate in the circumferential direction 106. The hot combustion gases flow through each of the stages 174, 176, and 178 applying motive forces to the blades 180 within each stage 174, 176, and 178. The hot combustion gases may then exit the gas turbine section 130 into an exhaust diffuser section 188 of the gas turbine engine 100. The exhaust diffuser section 188 reduces the velocity of fluid flow of the exhaust combustion gases from the gas turbine section 130, and also increases the static pressure of the exhaust combustion gases to increase the work produced by the gas turbine engine 100. As illustrated, the exhaust diffuser section 188 has a length 190, which is a portion of an overall length 192 of the gas turbine engine 100.

In the illustrated embodiment, the last turbine bucket section 178 of the turbine section 130 includes a clearance 194 between ends of a plurality of last turbine bucket blades 195 (e.g., the last blade 180 of the gas turbine section 130) and a stationary shroud 196 disposed about the plurality of last turbine bucket blades 195. Further, an outer wall 198 extends from the stationary shroud 196. A strut 200 is illustrated abutting the outer wall 198. Struts 200 are used to support the structure of the exhaust diffuser section 188. The last turbine bucket section 178 and the exhaust diffuser section 188 may be integrally designed to improve radial swirl and efficiency of the gas turbine engine 100. More specifically, as described in greater detail below, an outer wall of the last turbine bucket section 178 may be angled with respect to a centerline of the gas turbine engine 100 at a greater angle than an outer wall of the exhaust diffuser section 188 to affect the swirling of the exhaust combustion gases from the last turbine bucket section 178 and the exhaust diffuser section 188 to improve the efficiency of the gas turbine engine 100.

Figure 2:
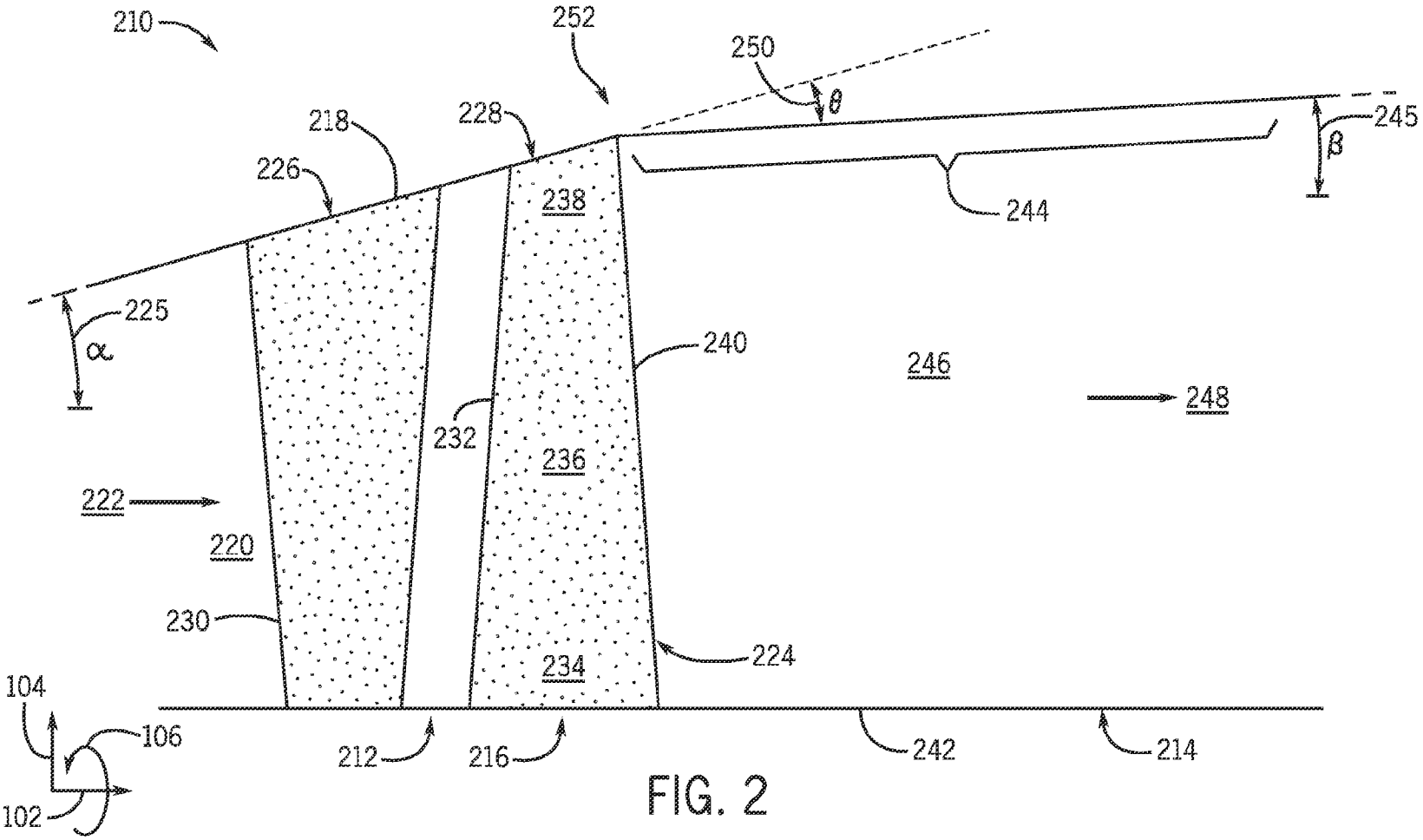
FIG. 2 illustrates a side view of an embodiment of a last stage bucket section and a diffuser section integrated together.

FIG. 2 illustrates a side view of an embodiment of a last stage bucket section and a diffuser section integrated together. An integrated system 210 is illustrated in FIG. 2 that includes a turbine section 212 (e.g., such as the gas turbine section 130 of the gas turbine engine 100 of FIG. 1) and a diffuser section 214 (e.g., the exhaust diffuser section 188 of the gas turbine engine 100 of FIG. 1). As described above, in certain embodiments, the turbine section 212 and the diffuser section 214 may be part of a gas turbine engine (e.g., the gas turbine engine 100 of FIG. 1). However, in other embodiments, the turbine section 212 and the diffuser section 214 may be part of other systems, such as a steam turbine engine, and so forth.

The turbine section 212 includes an annular platform 216 extending axially 102, parallel to a centerline of the turbine section 212 and an annular casing 218 (e.g., including an annular outer wall). The annular casing 218 circumferentially 106 surrounds the annular platform 216 to define a fluid passage 220 along which fluid (e.g., the exhaust combustion gases of FIG. 1) may flow from an upstream turbine section entrance 222 to a downstream turbine section exit 224. As illustrated, the annular casing 218 is angled with respect to the annular platform 216, and therefore, the annular casing 218 is angled with respect to the centerline of the turbine section 212. Further, although the annular casing 218 appears to extend at one angle, the angle that the annular casing 218 extends may vary and have portions with different angles, therefore, the angle that the annular casing 218 extends is quantified as an angle average $\alpha$ 225 (e.g., a weighted average of the different angles of the annular casing 218, weighted according to the length each angle extends). For example, in certain embodiments, the angle average a 225 of the annular casing 218 may be approximately 16 to 30 degrees, 17 to 24 degrees, or 19 to 23 degrees relative to the annular platform 216. Specifically, in certain embodiments, the angle average $\alpha$ 225 of the annular casing 218 may be approximately 16-25 degrees relative to the annular platform 216, and therefore relative to the centerline of the annular platform 216. The turbine section 212 may be sequentially arranged in sections, such as with an intermediate stage section 226 and a last stage section 228, relative to a direction of fluid flow along the fluid passage 220. At each stage, an array of turbine buckets, such as an intermediate stage turbine bucket 230 and a last stage turbine bucket 232, are arrayed circumferentially 106 around the annular platform 216.

In certain embodiments, the last stage turbine bucket 232 includes a hub 234, which is coupled to an outer radial section of the annular platform 216, an airfoil section 236 having an airfoil shape that interacts with the fluids flowing through the fluid passage 220 and extending radially 104 from the hub 234 to a tip 238. The tip 238 is disposed at a distal end of the airfoil section 236 and is proximate to an interior surface of the annular casing 218. The last stage turbine bucket 232 further includes a trailing edge 240, which is defined along an aft side of the hub 234, the airfoil section 236, and the tip 238 relative to a direction of fluid flow along the fluid passage 220. With each turbine bucket in the respective array of turbine buckets for each stage formed substantially as described above, mechanical energy can be derived from the rotation of the turbine buckets at each of the stages caused by the interaction of the fluid flowing along the fluid passage 220 with the turbine buckets.

The diffuser section 214 is defined between a central surface 242 extending axially 102, parallel to a centerline of the diffuser section 214, which may be an exterior facing surface of an annular diffuser central body, and a downstream diffuser section 244 of the annular casing 218. It should be noted that the centerline of the turbine section 212 and the centerline of the diffuser section 214 may be equivalent so that a continuous centerline extends through both the turbine section 212 and the diffuser section 214. As may be appreciated, the downstream diffuser section 244 may be angled relative to the central surface 242. Further, although the diffuser section 244 appears to extend at one angle, the angle that the diffuser section 244 extends may vary and have portions with different angles, therefore, the angle that the diffuser section 244 extends is quantified as an angle average β 245 (e.g., a weighted average of the different angles of the diffuser section 244, weighted according to the length each angle extends). For example, in certain embodiments, the angle average β 245 of the downstream diffuser section 244 may be approximately 11.50 to 14.25 degrees, 13.75 to 20.00 degrees, or 15.25 to 17.50 degrees relative to the central surface 242, and therefore relative to the centerline of the central surface 242. Specifically, in certain embodiments, the angle average β 245 of the downstream section 244 may be approximately 19 degrees relative to the central surface 242. The diffuser section 214 is fluidly coupled to the turbine section 212 and is disposed downstream from the trailing edge 240 of the last stage turbine bucket 232. Thus, as fluid flows over and past the trailing edge 240 of the last stage turbine bucket 232, the fluid exits the turbine section 212 and enters the diffuser section 214. Within the diffuser section 214, the fluid flows along a diffuser flow path 246 whereby the fluid flow is conditioned for further use downstream in, for example, a heat recovery steam generator (HRSG) 248.

As illustrated in FIG. 2, a slope of the downstream diffuser section 244 of the annular casing 218 may be angled relative to a slope of the tip 238, which is defined axially 102 along a radially 104 distal end of the tip 238. The angling may occur at the trailing edge 240 of the last stage turbine bucket 232 or at least within about 0.5 turbine bucket chord lengths, TL, from the trailing edge 240 of the last stage turbine bucket 232. The chord length, TL, of the last stage turbine bucket 232 may, for example, be measured at the tip 238.

The sloped downstream diffuser section 244 forms an angle average θ 250 with respect to the sloped tip 238. In certain embodiments, the angle average θ 250 may be approximately 2.00 to 10.50 degrees, 8.25 to 15.75 degrees, or 12.75 to 20.25 degrees. Specifically, in certain embodiments, the angle average θ 250 may be approximately 6.75 degrees. It may be appreciated that the angle average θ 250 is the difference between the angle average α 225 and the angle average β 245 and, therefore, the transition between the annular casing 218 relative to the annular platform 216 and the diffuser section 244 of the annular casing 218 may be angled differently by approximately the angle average θ 250. Further, as illustrated in FIG. 2, the angle average α 225 of the annular casing 218 relative to the annular platform 216 may be greater than the angle average β 245 of the downstream diffuser section 244 of the annular casing 218 relative to the central surface 242. In addition, the annular platform 216 and the central surface 242 may form an angle of approximately zero degrees relative to one another. It should be noted that there may be an outer wall transition section 252 between the annular casing 218 and the diffuser section 244. In this transition section, the outer wall transitions from the angle average a 225 to the angle average β 245. As will be appreciated, such a transition may be a single angle step transition, a curvature transition, and/or a multi-angled transition to transition between the annular casing 218 (e.g., last stage bucket outer wall) and the diffuser section 244 (e.g., diffuser section outer wall).

It should be noted that the system 210 may be part of either a gas turbine or a steam turbine. Further, such a system may be constructed by: providing the last stage section 228 and the diffuser section 214, as described above, and attaching both sections 228 and 214 together to form the integrally designed turbine system.

Figure 3:
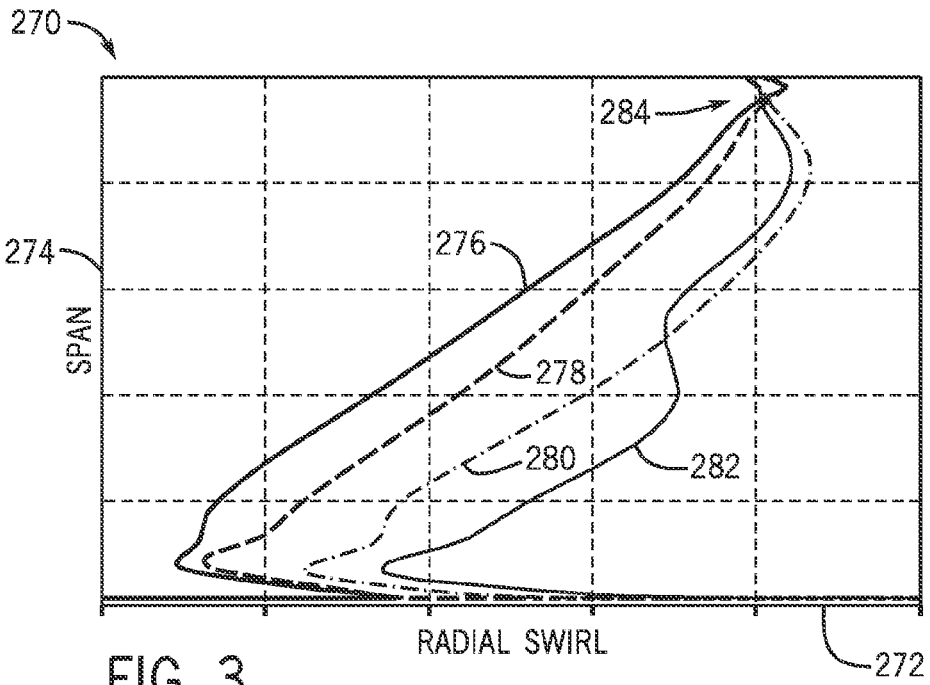
FIG. 3 illustrates a graph of an amount of radial swirl that may occur in an embodiment of an integrally designed turbine system under various operating conditions.

FIG. 3 illustrates a graph 270 of an amount of radial swirl 272 that may occur in an embodiment of an integrally designed turbine system (e.g., the system 210 of FIG. 2) under various operating conditions. The radial swirl 272 (axis x) is a number of degrees relative to a span percentage 274 (axis y). The span percentage 274 represents a percentage of the radial 104 area between the central surface 242 and the downstream diffuser section 244 of the annular casing 218. In certain embodiments, where the radial swirl 272 axis intersects the span percentage 274 axis, the span percentage 274 may be approximately 0 percent. Conversely, at the opposite end of the span percentage 274 axis, the span percentage 274 may be approximately 100 percent.

A first curve 276 depicts the radial swirl 272 during full speed full load (FSFL) conditions (e.g., 100 percent load), while a second curve 278 depicts the radial swirl 272 during 80 percent load conditions. Further, a third curve 280 depicts the radial swirl 272 during 60 percent load conditions, and a fourth curve 282 depicts the radial swirl 272 during 40 percent load conditions. As illustrated, each of the curves 276, 278, 280, and 282 follows a similar pattern of having a low radial swirl 272 in conjunction with a low span percentage 274, then, the curves 276, 278, 280, and 282 have a generally increasing radial swirl 272 as the span percentage 274 approaches the maximum percentage. Specifically, the curves 276, 278, 280, and 282 converge toward a location 284. In certain embodiments, the radial swirl 272 at location 284 may be approximately 14 to 18 degrees, 15 to 17 degrees, or 16 to 19 degrees. In particular, in certain embodiments, the radial swirl 272 at location 284 may be approximately 16 degrees. As may be appreciated, the radial swirl 272 may be approximately 20 to 40 percent, 30 to 50 percent, or 25 to 35 percent greater in turbine systems 210 where the last stage turbine section 228 and the diffuser section 214 are integrally designed (e.g., as described above with respect to the system 210 of FIG. 2) as compared to turbine systems where the last stage turbine section 228 and the diffuser section 214 are designed independently. In certain embodiments, the radial swirl 272 may be approximately 33 percent greater in integrally designed systems 210 when compared to independently designed systems.

Figure 4:
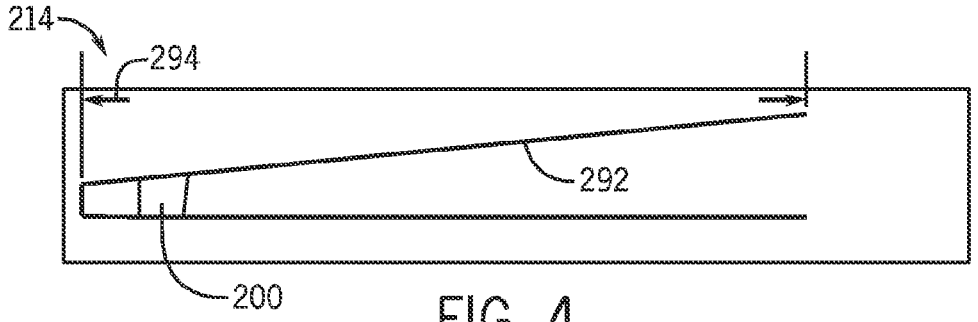
FIG. 4 illustrates an embodiment of the diffuser section of FIG. 2.

FIG. 4 illustrates an embodiment of the diffuser section 214 of FIG. 2. As illustrated, the diffuser section 214 has a length 294. In certain embodiments, the length 294 of the diffuser section 214 may be approximately 12 to 14 m, 13 to 15 m, or 13 to 14 m. Specifically, the length 294 of the diffuser section 214 may be approximately 13.2 m. By integrally designing the last stage turbine section 228 and the diffuser section 214, the length 294 of the diffuser section 214 may be approximately 25 to 180 cm, 20 to 100 cm, or 50 to 80 cm shorter than a similar diffuser section 214 in an independently designed system. Specifically, the diffuser section 214 may be approximately 30 cm shorter in an integrally designed turbine system 210 than in an independently designed system. Such a decrease in length may correspond to a decrease in length by approximately 5 to 20 percent, 10 to 30 percent, or 8 to 15 percent. Specifically, the decrease in length may correspond to a decrease in length of approximately 10 percent. Further, the decrease in length 294 of the diffuser section 214 may be associated with a significant decrease in cost to produce the diffuser section 214.

Figure 5:
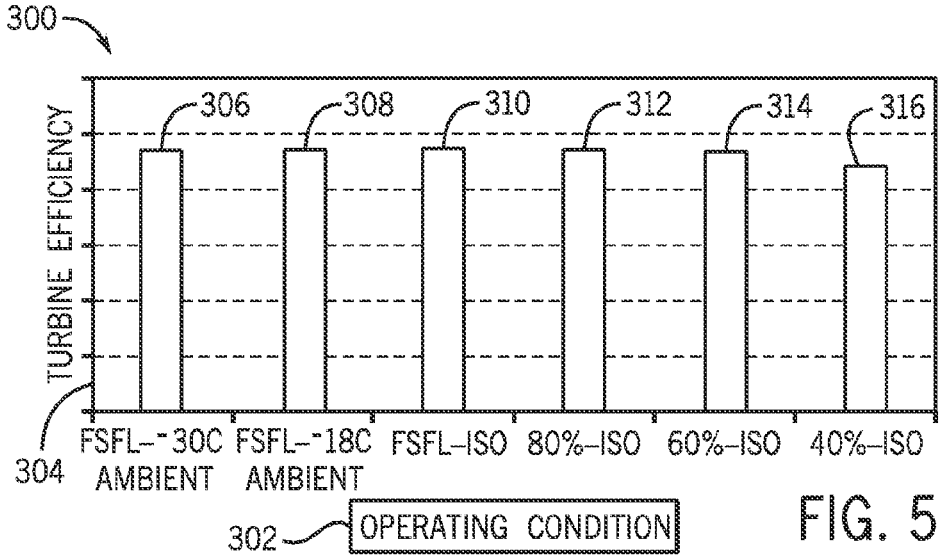
FIG. 5 illustrates a graph of an embodiment of the efficiency that may occur in an integrally designed turbine system under various operating conditions.

FIG. 5 illustrates a graph 300 showing how various operating conditions 302 may affect efficiency 304 that may occur in the integrally designed turbine system 210. Specifically, at FSFL and approximately −30° C., the efficiency may be represented by a bar 306. Further, at FSFL and approximately −18° C., the efficiency may be represented by a bar 308. In addition, at FSFL and ISO conditions (ISO conditions are conditions defined by the International Organization of Standardization), the efficiency may be represented by a bar 310. At approximately 80 percent load and ISO conditions, the efficiency may be represented by a bar 312. In particular, at approximately 60 percent load and ISO conditions, the efficiency may be represented by a bar 314. Further, at approximately 40 percent load and ISO conditions, the efficiency may be represented by a bar 316.

As a whole, the bars 306, 308, 310, 312, 314, and 316 illustrate that the turbine efficiency 304 remains relatively stable among the operating conditions 302 shown. In other words, with varying temperatures and loads, the efficiency 304 remains high. In particular, at cold temperatures and low percentages of load conditions, the efficiency 304 remains high. In certain embodiments, the efficiency 304 among the bars 306, 308, 310, 312, 314, and 316 may range from approximately 88 to 94 percent, 90 to 95 percent, or 82 to 90 percent. As may be appreciated, the efficiency 304 shown among the bars 306, 308, 310, 312, 314, and 316 may demonstrate that an integrally designed system is approximately 1 to 20 percent, 5 to 30 percent, or 10 to 18 percent more efficient than systems that are independently designed. Specifically, at FSFL and approximately −30° C., the efficiency represented by bar 306 may be approximately 1.5 percent greater than an independently designed system. Such an improvement in efficiency may cause an increase of approximately 5 MW of power output in the integrally designed system compared to the independently designed system.

As previously described, there may be a number of technical advantages for integrally designing components for the turbine system 212, when compared to independently designed components. In particular, the radial swirl 272 may be increased. Further, the length 294 of the diffuser section 212 may be reduced, which may reduce costs associated with manufacturing the diffuser section 212. In addition, the efficiency 304 of the turbine system 212 may remain high in cold and low load conditions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a gas turbine, comprising:

a last stage bucket section having a first annular outer wall that is angled with respect to a centerline of the gas turbine at a first angle average; and an axial diffuser section disposed immediately downstream of the last stage bucket section, the axial diffuser section having a second annular outer wall that is angled with respect to the centerline of the gas turbine at a second angle average for improving radial swirl, wherein the first angle average is approximately 20-30 degrees, the second angle average is approximately 12-20 degrees, the first angle average is approximately 2-15 degrees greater than the second angle average, the last stage bucket section and the axial diffuser section couple to one another at a transition point, and a first angle of the last stage bucket section with respect to the centerline is greater than a second angle of the axial diffuser section with respect to the centerline at the transition point.

2. The system of claim 1, wherein the first angle average is greater than the second angle average by approximately 6.75 degrees.

3. The system of claim 1, wherein the first angle average is approximately 25 degrees.

4. The system of claim 1, wherein the second angle average is approximately 19 degrees.

5. The system of claim 1, wherein the second angle average is substantially constant.

6. A system, comprising:

a gas turbine having an outer wall transition from a last stage bucket outer wall directly to an axial diffuser section outer wall, wherein the last stage bucket outer wall is angled away from a centerline of the gas turbine at a first angle that is approximately 2-15 degrees greater than a second angle at which the axial diffuser section outer wall is angled away from the centerline of the gas turbine at the outer wall transition, wherein the first angle is approximately 20-30 degrees, and the second angle is approximately 12-20 degrees.

7. The system of claim 6, wherein the first angle is greater than the second angle by approximately 6.75 degrees.

8. The system of claim 6, wherein the first angle is approximately 22 degrees, and the second angle is approximately 17 degrees.

9. A method, comprising:

providing a last stage bucket section of a gas turbine that is outwardly angled with respect to an axial centerline of the last stage bucket section from a first axial end of the last stage bucket section to a second axial end of the last stage bucket section at a substantially constant first angle;

providing an axial diffuser section of the gas turbine that is outwardly angled with respect to an axial centerline of the axial diffuser section at a first axial end of the axial diffuser section at a second angle;

providing the last stage bucket section that is outwardly angled at the substantially constant first angle of approximately 20-30 degrees, and the axial diffuser section that is outwardly angled at the second angle of approximately 12-20 degrees; and attaching the second axial end of the last stage bucket section to the first axial end of the axial diffuser section at a transition point, wherein the first angle is approximately 2-15 degrees greater than the second angle at the transition point.

10. The method of claim 9, comprising providing the last stage bucket section that is outwardly angled at the substantially constant first angle of approximately 22 degrees, and providing the axial diffuser section that is outwardly angled at the second angle of approximately 17 degrees.

* * * * *